United States Patent [19]

Gutman

[11] Patent Number: 4,510,236

[45] Date of Patent: Apr. 9, 1985

[54] THERMALLY GENERATED TONING AGENT SYSTEM FOR PHOTOTHERMOGRAPHIC IMAGING COMPOSITIONS

[75] Inventor: Gustav Gutman, Lake Elmo, Minn.

[73] Assignee: Minnesota Mining and Manufacturing Company, St. Paul, Minn.

[21] Appl. No.: 563,687

[22] Filed: Dec. 20, 1983

[51] Int. Cl.[3] ..... G03C 1/00

[52] U.S. Cl. ..... 430/619; 430/620

[58] Field of Search ..... 430/619, 620

[56] References Cited

U.S. PATENT DOCUMENTS

| | | | |
|---|---|---|---|
| 3,446,648 | 5/1969 | Workman | 117/36.8 |
| 3,457,075 | 7/1969 | Morgan et al. | 96/67 |
| 3,994,732 | 11/1976 | Winslow | 85/114.1 |
| 4,076,534 | 2/1978 | Noguchi et al. | 96/63 |
| 4,125,403 | 11/1978 | Ikenoue et al. | 96/114.1 |
| 4,128,428 | 12/1978 | Ikenoue et al. | 430/618 |
| 4,144,072 | 3/1979 | Ikenoue et al. | 96/114.1 |
| 4,152,160 | 5/1979 | Ikienoue et al. | 430/620 |
| 4,207,112 | 6/1980 | Ikenoue et al. | 96/114.1 |
| 4,376,162 | 3/1983 | Kawata et al. | 430/618 |

*Primary Examiner*—Mary F. Downey

*Attorney, Agent, or Firm*—Donald M. Sell; James A. Smith; David L. Weinstein

[57] ABSTRACT

Thermally developable light sensitive material containing a light sensitive silver halide, an oxidizing agent, a reducing agent, and a combination of 2-(hydroxymethyl)-1(2H)-phthalazinone as a toning agent precursor and certain polycarboxylic acids or derivatives thereof as a catalyst for said toning agent precursor. Upon heat development of the exposed photothermographic material, the 2-(hydroxymethyl)-1(2H)-phthalazinone decomposes to form phthalazinone. The thus-formed phthalazinone acts as a toning agent for the light exposed silver halide.

15 Claims, No Drawings

THERMALLY GENERATED TONING AGENT SYSTEM FOR PHOTOTHERMOGRAPHIC IMAGING COMPOSITIONS

BACKGROUND OF THE INVENTION

The present invention relates to a thermally developable light-sensitive material, and particularly to a thermally developable light-sensitive material which provides pure black tone images and whose shelf life (i.e., the ability of the thermally developable light-sensitive material to retain photographic properties initially possessed even after prolonged storage) and developing speed are improved.

A variety of methods which comprise subjecting photographic materials containing light-sensitive components such as silver halide or the like to a so-called dry processing by heating to thereby obtain an image are known. Of these light-sensitive materials which can form photographic images using dry processing, the most common one is a thermally developable light-sensitive material as described in U.S. Pat. Nos. 3,152,904, 3,457,075, 3,707,377 and 3,909,271, in which an oxidation-reduction image forming composition comprising, as essential components, organic silver salt oxidizing agents (for example, silver behenate), photocatalysts such as light-sensitive silver halide, and reducing agents (for example, 2,2'-methylenebis[4-methyl-6-t-butyl]phenol) is utilized. While the thermally developable light-sensitive material is stable at ambient temperature, after exposure to light, the organic silver salt oxidizing agent and reducing agent present in the light-sensitive layer undergo, when heated generally at temperatures of higher than about 80° C., preferably greater than about 100° C., an oxidation-reduction reaction due to the catalytic action of the photocatalyst which is present in proximity to the organic silver salt oxidizing agent and reducing agent to thereby form silver. The exposed areas of the light-sensitive layer are rapidly darkened so that a contrast is formed between the unexposed areas (background) to form an image.

In most cases, the image provided by the thermally developable light-sensitive material using the above described silver salt oxidizing agent is yellow brown in color. However, it is known that, by incorporating a color toning agent therein, the thermally developable light-sensitive material can be improved so as to obtain an image having a good black tone. U.S. Pat. No. 3,457,075 discloses that phthalazinone can be employed alone as a color toning agent. However, when used alone, phthalazinone exhibits poor shelf life, particularly at high humidity.

The use of 2-(hydroxymethyl)-1(2H)-phthalazinone as a toning agent precursor is disclosed in U.S. Pat. No. 4,125,403. 2-(Hydroxymethyl)-1(2H)-phthalazinone has been found to yield phthalazinone according to the following thermal decomposition reaction:

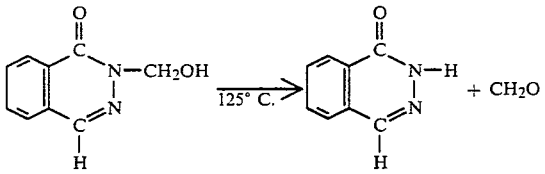

2-(Hydroxymethyl)-1(2H)-phthalazinone was found to be desirable for several reasons, chief among them being (1) minimization of fog generated during solution aging and shelf storage of coated photothermographic products with little sensitivity loss, (2) improved solubility over phthalazinone, allowing better retention in coated products, and (3) absence of sublimation, which fouls most commercially available reader-printer apparatus. However, the appearance of the phthalazinone toner by means of the thermal decomposition reaction was found to be too slow for most commercially feasible photothermographic formulations.

SUMMARY OF THE INVENTION

This invention involves a heat developable light sensitive material containing (a) at least one oxidizing agent, (b) at least one light-sensitive silver halide, (c) at least one reducing agent, and further containing as a toning agent precursor (d) 2-(hydroxymethyl)-1(2H)-phthalazinone, and (e) as a catalyst for converting the toning agent precursor to a toning agent, at least one compound, in a catalytically effective amount, selected from the group consisting of aromatic carbocyclic polycarboxylic acids or derivatives thereof, aromatic carbocyclic polycarboxylic anhydrides or derivatives thereof, and heterocyclic polycarboxylic acids or derivatives thereof.

Upon heat development of the exposed light sensitive material, the 2-(hydroxymethyl)-1(2H)-phthalazinone is converted to phthalazinone. The polycarboxylic acid allows this conversion to take place rapidly enough to be effective during the development process. The toning agent, i.e., phthalazinone, is not present until required, thus, in effect, resulting in stabilization thereof.

DETAILED DESCRIPTION

The appearance of the toning agent results from application of heat to a mixture comprising the toning agent percursor and the catalyst. 2-(Hydroxymethyl)-1(2)-phthalazinone, the toning agent precursor suitable for this invention, can be represented by the formula:

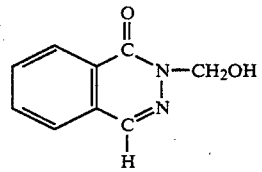

Catalysts suitable for this invention must contain at least two substituent groups selected from

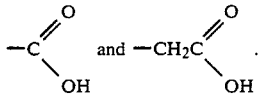

Catalysts suitable for use in the practice of the present invention can be represented by the following formulas:

$R(COOH)_n$ $R(CH_2COOH)_n$ wherein

R represents a member of the group selected from monocyclic or polycyclic carbocylic aromatic radicals, said polycyclic radicals having up to three fused rings, e.g., 1,2-phenylene ( 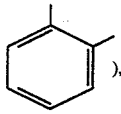 ), 2,3-napthylene ( 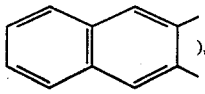 ), and 4-methyl-1,2-phenylene ( 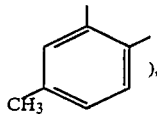 ), and monocyclic heterocyclic radicals, e.g.

2,3-pyridinylene ( 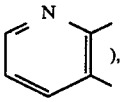 ), and tetrahydrofuryul radical ( 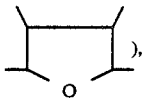 ), and n is an integer from 2 to 4, inclusive.

It is preferred that the —COOH or —$CH_2COOH$ groups be located ortho to each other. The —COOH or —$CH_2COOH$ groups can be meta to each other, but this is less preferred. Least preferred are those compounds wherein the —COOH or —$CH_2COOH$ groups are para to each other. The rings can contain substituents other than —COOH or —$CH_2COOH$ groups so long as their substituents do not adversely affect the photothermographic imaging process. Representative examples of polycarboxylic acids suitable in the practice of this invention are 2,3-naphthalene-dicarboxylic acid, 4-methylphthalic acid, 2,3-pyridinedicarboxylic acid, phthalic acid, 1,3,5-benzene-tricarboxylic acid, 1,4,5,8-naphthalenetetracarboxylic acid, pyromellitic acid, phthalic anhydride, and homophthalic acid. The preferred polycarboxylic acids are aromatic dicarboxylic acids, one preferred acid being 2,3-naphthalenedicarboxylic acid, based upon increase in speed over compositions not containing the acid, another preferred acid being phthalic acid, based on commercial availability.

Anhydrides that are analogous to the acids that are suitable for the practice of this invention are also suitable for the invention. Derivatives of acids that are suitable for this invention include half-esters, such as monobutylphthalate.

The amount of toning agent precursor and catalyst can vary in the photothermographic formulations. Sufficient amounts of these components must be incorporated in the formulations to produce the desired image intensity with minimum adverse effects on other properties, such as shelf life.

Concentrations of these components are dependent upon the following:

(1) strength of reducing agent or developer, (2) proportions of silver salts and other reactants in the photothermographic composition, (3) thickness of coating, (4) developing conditions, e.g., heat development time and temperature.

In general, the concentration of toning agent precursor will range from about 0.5 to about 6.0, preferably from about 2.0 to about 4.0, percent by weight, based on the weight of the photothermographic composition, and the concentration of catalyst will range from about 0.0050 to about 0.080, preferably from 0.020 to 0.065, percent by weight, based on the weight of the photothermographic composition.

The toning system of the present invention is useful with photothermographic systems that comprise the following ingredients applied to a suitable support:

(a) photosensitive silver halide prepared in situ or ex situ, (b) an oxidation-reduction image-forming combination comprising:

(i) a metallic salt or complex of an organic compound as an oxidizing agent, and (ii) an organic reducing agent or developing agent, and (c) a vehicle or binder.

Photosensitive silver halide can be generated in situ throughout the surface of the coating of the organic silver salt, or it can be added as a preformed material. U.S. Pat. No. 3,457,075, incorporated herein by reference, describes formation of photosensitive silver halide by an in situ process. U.S. Pat. No. 3,871,887, incorporated herein by reference, describes addition of preformed photosensitive silver halide to a photothermographic imaging composition.

Oxidizing agents (b) (i) suitable for the practice of the present invention include silver salts of long chain fatty acids having 12 to 24 carbon atoms, silver salts of organic compounds have 6 to 24 carbon atoms and containing an imino group, and silver salts of organic compounds having 4 to 10 carbon atoms and containing a mercapto group or a thione group. Specific examples of such oxidizing agents include silver behenate, silver arachidate, silver nonadecanoate, silver stearate, silver heptadecanoate, silver palmitate, silver laurate, silver saccharinate, 5-substituted salicyladoxime silver salt, benzotriazole silver salt, phthalazinonc silver salt, 3 mercapto-4-phenyl-1,2,4-triazole silver salt, and the like. Silver behenate and silver arachidate are the most suitable. The above-mentioned oxidizing agents may be used alone or in mixture.

Organic reducing agents (b) (ii) suitable for the practice of the present invention include substituted or unsubstituted bisphenols, substituted or unsubstituted naphthols, di- or polyhydroxybenzenes, hydroquinone ethers, ascorbic acids or its derivatives, 3-pyrazolidones, pyrazoline-5-ones, reducing sugars and the like. Specific examples of such reducing agents include hydroquinone, methylhydroquinone, chlorohydroquinone, bromohydroquinone, phenylhydroquinone, t-octylhydroquinone, t-butylhydroquinone, 2,5-dimethylhydroquinone, 2,6-dimethylhydroquinone, methoxyhydroquinone, methoxyphenol, hydroquinone monobenzyl ethers, catechol, pyrogallol, resorcin, p-aminophenol, 2,4,4-trimethylpentyl-bis(2-hydroxy-3,5-dimethylphenyl)methane, bis(2-hydroxy-3-t-butyl-5-methylphenyl)methane, bis(2-hydroxy-3,5-di-t-butylphenyl)methane, 4,4'-methylenebis(2-methyl-6-t-butylphenol), 4,4'-methylenebis(2,6-di-t-butylphenol), 2,2'-methylenebis(6-t-butyl-4-ethoxyphenol), methylhydronaphthalene, phenidone, methyl gallate, lactose, ascorbic acid and the like. The above-mentioned reducing agents may be alone or in mixture. A suitable reducing agent may be chosen depending on the organic silver salt oxidizing agent employed in combination therewith. For example, when there is employed as the oxidizing agent a long chain fatty acid silver salt such as silver behenate which is relatively hard to reduce, relatively strong reducing agents, e.g. a bisphenol such as 2,2'-methylenebis(4-methyl-6-t-butyl)phenol, are preferably employed. On the other hand, with organic silver salt oxidizing agents such as silver laurate which are relatively easy to reduce, relatively weak reducing agents, e.g. substituted phenols such as p-phenylphenol, are preferably employed. With organic silver salt oxidizing agents such as benzotriazole silver salt which is very hard to reduce, stronger reducing agents such as ascorbic acids are preferably employed.

Binders (c) suitable for the practice of the present invention include such materials as polyvinyl butyral, polyvinyl alcohol, polyvinyl acetate, cellulose acetate propionate, cellulose acetate butyrate.

The support has to be stable at processing temperatures between 60° and 150° C. Suitable supports include sheets or foils of a paper, cellulose acetate, polyethylene terephthalate, fabric, metal foils, and glass. In the case of a paper support, the paper may carry the usual auxiliary layers such as baryta coatings, polyethylene coatings, and the like.

The system can also comprise other conventional photographic addenda, for example, antifoggants, spectral sensitizing dyes, development modifiers, auxiliary reducing agents, coating aids, image stabilizers, activators, image stabilizer precursors, and the like.

The following non-limiting examples will further illustrate this invention.

EXAMPLE I

A light-sensitive composition was prepared by the following procedure:

An homogenate of silver behenate was made with 12 parts by weight silver behenate, 59.4 parts by weight methyl ethyl ketone, 22.9 parts by weight toluene, and 5.6 parts by weight methylisobutyl ketone.

200 grams of this homogenate was mixed under green light dark room conditions with 0.8 gram polyvinyl butyral, 0.2 gram 1-methyl-2-pyrrolidone, 0.125 gram $HgBr_2$ dissolved in 1.85 gram methanol, and 1.25 grams HBr mixed with 9.4 grams methyl ethyl ketone.

22.6 grams of polyvinyl butyral (Butvar ®76, Monsanto Company), 5.02 grams vinyl chloride-acetate resin (VAGH, Union Carbide Corporation), 3.62 grams 2,2'-methylene bis(4-methyl-6-t-butyl)phenol, 0.006 gram Victoria Pure Blue in 0.5 gram methanol, and 0.015 gram dye I* in a solvent mixture comprising 1.9 grams methanol and 6.3 grams toluene were then added to the foregoing mixture.

*Dye I is represented by the formula:

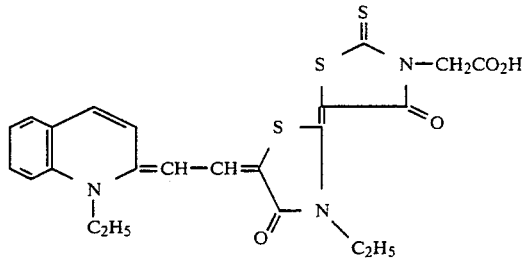

The foregoing composition was applied to a 4 mil polyethylene terephthalate sheet by means of a knife coater with a 3.5 mil orifice. The composition was dried at 190° F. (87.8° C.) for 3 minutes.

A top coat composition was prepared by combining the following ingredients in the amounts indicated:

| Ingredient | Amount (parts by weight) |
|---|---|
| Methyl ethyl ketone | 290 |
| Vinyl chloride-acetate resin (VYNS, Union Carbide Corporation) | 9 |
| Toning agent precursor or toning agent | as indicated in Table I |
| Aromatic polycarboxylic acid catalyst | as indicated in Table I |

The top coat composition was applied over the light-sensitive composition by means of a knife coater with a 2.5 mil orifice, to form a film. The topcoat was dried at 190° F. (87.8° C.) for 3 minutes. Each film sample was exposed through a transparent continuous wedge by means of a tungsten projector to give an exposure of 1000 meter-candle-seconds. Subsequently, the material was heat developed for 20 seconds at 260° F. The development equipment included a continuous heated drum.

The results of these runs are set forth in the following table:

TABLE I

| Run No. | Concentration of toning agent or toning agent precursor and catalyst (% by weight) HMPAZ[a] | PAZ[b] | PA[c] | Dmin | Dmax | Gamma (°) | Relative sensitivity[d] |
|---|---|---|---|---|---|---|---|
| 1 | 3 | — | — | .14 | 2.38 | 70.1 | 100 |
| 2 | 3 | — | .02 | .15 | 2.60 | 57.1 | 468 |
| 3 | 4 | — | .01 | .15 | 2.61 | 64.4 | 380 |
| 4 | 2 | — | .02 | .16 | 2.56 | 56.5 | 588 |
| 5 | — | 1.7 | — | .16 | 2.96 | 67.3 | 490 |
| 6 | — | 1.7 | .01 | .41 | 2.85 | 55.4 | 912 |
| 7 | — | 1.2 | .01 | .18 | 2.97 | 62.8 | 512 |
| 8 | — | .6 | .01 | .20 | 3.09 | 69.8 | 363 |

[a]HMPAZ = 2-(hydroxymethyl)-1(2H)-phthalazinone toning agent precursor
[b]PAZ = phthalazinone toning agent
[c]PA = phthalic acid catalyst
[d]Relative sensitivity is defined as the ratio of sensitivity of the film sample for a given run divided by the sensitiviy of the film sample for Run No. 1 times 100. Sensitivity is expressed by the reciprocal of the exposure amount necessary to provide an optical density of fog + 0.6.

The data in Table I show that photothermographic compositions containing 2-(hydroxymethyl)-1(2H)-phthalazinone and phthalic acid (run nos. 2, 3, 4) exhibit significantly enhanced relative sensitivity values compared to a composition containing 2-(hydroxymethyl)-1(2H)-phthalazinone but no acid catalyst (run no. 1), while continuing to maintain relatively constant values of Dmin and Dmax. Although the composition of run no. 6, wherein phthalazinone is employed as the toning agent, exhibits enhanced relative sensitivity, the value of Dmin is too high for the composition to be of practical value. In run no. 8, phthalazinone and phthalic acid were placed in the light-sensitive composition, rather than in the top coat composition, in an attempt to reduce the value of Dmin to an acceptable level. Although the value of Dmin was reduced from 0.41 to 0.20, the relative sensitivity was also reduced from 912 to 363, thus sacrificing relative sensitivity while not enhancing Dmin to the level exhibited by photothermographic articles employing 2-(hydroxymethyl)-1(2H)-phthalazinone as a toning agent precursor. Certain deleterious effects of phthalazinone toning agent, when present in the light-sensitive composition, are shown in Examples III and IV.

EXAMPLE II

This example further demonstrates the effect of the 2-(hydroxymethyl)-1(2H)-phthalazinone toning agent precursor/phthalic acid catalyst combination on the stability of a photothermographic system.

The light-sensitive system was prepared as in Example I. The photothermographic elements were aged at 160° F. (71° C.) for 20 minutes in a forced air oven. The results of forced aging are shown in Table II.

TABLE II

| Toning Agent | Concentration (% by weight) | Dmin before aging | Dmin after aging | Dmax before aging | Dmax after aging | Sensitivity (meter-candle-seconds) before aging | Sensitivity (meter-candle-seconds) after aging | Gamma (°) before aging | Gamma (°) after aging |
|---|---|---|---|---|---|---|---|---|---|
| 2-(hydroxymethyl)-1(2H)-phthalazinone | 2.0 | .16 | .16 | 2.56 | 2.60 | .20 | .13 | 57 | 62 |
| phthalazinone | 1.2 | .18 | .30 | 2.97 | 2.95 | .17 | .11 | 63 | 62 |
| phthalazinone | 1.7 | .41 | .53 | 2.85 | 2.85 | .30 | .21 | 55 | 57 |

The data in Table II show that a given photothermographic composition containing unreacted 2-(hydroxymethyl)-1(2H)-phthalazinone toning agent precursor has very little effect on Dmin during accelerated high temperature aging when compared with a like photothermographic composition containing phthalazinone toning agent. The phthalazinone toning agent allows Dmin to rise to an unacceptable level.

EXAMPLE III

This example demonstrates the effect of the 2-(hydroxymethyl)-1(2H)-phthalazinone toning agent precursor/phthalic acid catalyst combination on the solution pot life of a photothermographic system.

The light-sensitive composition was prepared as in Example I with the exceptions that the toning agent precursor was introduced into the silver behenate portion and the light-sensitive coating composition was allowed to age at 70° F. (21° C.) for 48 hours before coating. Dmin, Dmax, sensitivity, and gamma were measured at 0 hours, 24 hours, and 48 hours. The results are shown in Table III.

TABLE III

| Toning Agent[a] | Concentration (% by weight) | Dmin 0 hrs | Dmin 24 hrs | Dmin 48 hrs | Dmax 0 hrs | Dmax 24 hrs | Dmax 48 hrs | Sensitivity (meter-candle-seconds) 0 hrs | Sensitivity 24 hrs | Sensitivity 48 hrs | Gamma (°) 0 hrs | Gamma (°) 24 hrs | Gamma (°) 48 hrs |
|---|---|---|---|---|---|---|---|---|---|---|---|---|---|
| phthalazinone | 1.6 | .21 | .21 | .23 | 3.13 | 2.78 | 2.47 | .34 | .23 | .11 | 61 | 56 | 52 |
| 2-(hydroxymethyl)-1(2H)-phthalazinone | 2.9 | .14 | .16 | .18 | 2.5 | 2.74 | 2.79 | .14 | .16 | .21 | 58 | 65 | 63 |

[a]Phthalic acid (0.02% by weight, based on the weight of total composition) was used in the top coat.

The data in Table III show that 2-(hydroxymethyl)-1(2H)-phthalazinone preserves the Dmin and Dmax values within an acceptable range while bringing about improvement in sensitivity and gamma upon standing.

EXAMPLE IV

This example demonstrates the effect of the 2-(hydroxymethyl)-1(2H)-phthalazinone toning agent precursor/phthalic acid catalyst combination on the stability of a photothermographic system.

The light-sensitive composition was prepared as in Example I, with the exception that the toning agent precursor was introduced into the silver behenate portion. The photothermographic elements were aged at 80° F. (26.6° C.) and 80% relative humidity. The results of aging under these conditions are shown in Table IV.

TABLE IV

| Toning Agent[a] | Concentration (% by weight) | Dmin 0 | Dmin 96 hrs | Dmax 0 | Dmax 96 hrs | Sensitivity (meter-candle-seconds) 0 | Sensitivity 96 hrs | Gamma (°) 0 | Gamma (°) 96 hrs |
|---|---|---|---|---|---|---|---|---|---|
| phthalazinone | 1.6 | .21 | .31 | 3.13 | 3.02 | .34 | .22 | 60 | 56 |
| 2-(hydroxymethyl)-1(2H)-phthalazinone | 2.4 | .15 | .14 | 2.50 | 2.62 | .12 | .11 | 55 | 56 |
| 2-(hydroxymethyl)-1(2H)-phthalazinone | 2.9 | .14 | .12 | 2.51 | 2.45 | .14 | .09 | 58 | 58 |

[a]Phthalic acid (0.02% by weight, based on the weight of total composition) was used in the top coat.

The data in Table IV show that sensitivity, gamma, and especially Dmin of a given photothermographic composition containing 2-(hydroxymethyl)-1(2H)-phthalazinone as a toning agent precursor change much less than do these values of a like photothermographic composition containing phthalazinone as a toning agent when both compositions are subjected to high humidity for 4 days.

EXAMPLE V

This example demonstrates the effect of various carboxylic acids and derivatives thereof within the scope of the present invention on speed of photothermographic film.

A stock photothermographic composition was prepared by the procedure employed to prepare the light-sensitive composition of Example I. The stock photothermographic composition was then divided into 100 g samples. To each sample was added 2 g 2-(hydroxymethyl)-1(2H)-phthalazinone and a specific carboxylic acid or carboxylic acid derivative. The concentration of the carboxylic acid or carboxylic acid derivative was 0.01 mole per mole of 2-(hydroxymethyl)-1(2H)-phthalazinone. The compositions were coated upon a support to form test samples. Each sample was exposed, developed, and tested under the same conditions as in Example I. The results are set forth in Table V.

TABLE V

| Acid | Amount of acid (g) | Dmin | Dmax | Relative sensitivity |
|---|---|---|---|---|
| None | 0.000 | .14 | 2.40 | 100 |
| 2,3-Naphthalene-dicarboxylic | 0.026 | .16 | 2.58 | 955 |
| 4-Methylphthalic | 0.022 | .15 | 2.74 | 891 |
| 2,3-Pyridine-dicarboxylic | 0.020 | .16 | 2.37 | 758 |
| Phthalic | 0.020 | .14 | 2.60 | 661 |
| 1,3,5-Benzene-tricarboxylic | 0.025 | .17 | 2.65 | 479 |
| 1,4,5,8-Naphthalene-tetracarboxylic | 0.036 | .20 | 2.34 | 355 |
| Pyromellitic | 0.031 | .18 | 2.48 | 355 |
| Phthalic anhydride | 0.018 | .16 | 2.55 | 295 |
| Homophthalic | 0.022 | .14 | 2.50 | 251 |
| Monobutylphthalate* | 0.033 | .15 | 2.47 | 178 |
| Tetrahydrofuran-tetracarboxylic | 0.030 | .18 | 1.97 | 1.58 |

*Monobutylphthalate is a derivative of phthalic acid.

COMPARATIVE EXAMPLE A

This example demonstrates the effect of various carboxylic acids and derivatives thereof not within the scope of the present invention on speed of photothermographic film. Preparation of the samples was identical to that employed for the samples of Example V. The results are set forth in Table VI.

TABLE VI

| Acid | Amount of acid (g) | Dmin | Dmax | Relative sensitivity |
|---|---|---|---|---|
| 2,3-Cyclohexane dicarboxylic | 0.021 | .13 | 2.09 | 76 |
| Benzoic | 0.030 | .14 | 2.43 | 107 |

The data in Table V show the aromatic polycarboxylic acids enhance the sensitivity of photothermographic compositions containing 2-(hydroxymethyl)-1(2H)-phthalazinone toning agent precursor. The data in Table VI show the non-aromatic polycarboxylic acids and aromatic monocarboxylic acids fail to enhance the sensitivity of photothermographic compositions containing 2-(hydroxymethyl)-1(2H)-phthalazinone toning agent precursor.

EXAMPLE VI

This example demonstrates the effect of varying the concentration of the carboxylic acid on speed of photothermographic film. A stock photothermographic composition was prepared according to the procedure employed to prepare the light-sensitive composition of Example I. The resulting stock composition was divided into portions, and to each portion 2-(hydroxymethyl)-1(2H)-phthalazinone and either phthalic acid or 4-methyl phthalic acid was added in the amount indicated in Table VII. The concentration of 2-(hydroxymethyl)-1(2H)-phthalazinone was 2.2 percent by weight. Each sample was then coated upon a support. Each was exposed, developed, and tested under the same conditions as in Example I. The results are set forth in Table VII.

TABLE VII

| Run No. | Acid | Concentration (%) | mole acid/ mole HMPAZ[a] X 1000 | Dmin | Dmax | Relative sensitivity |
|---|---|---|---|---|---|---|
| 1 | — | — | — | .16 | 2.46 | 100 |
| 2 | phthalic | .0025 | 1.2 | .16 | 2.44 | 106 |
| 3 | phthalic | .0050 | 2.4 | .17 | 2.45 | 143 |
| 4 | phthalic | .020 | 9.6 | .16 | 2.57 | 337 |
| 5 | phthalic | .035 | 16.9 | .15 | 2.61 | 322 |
| 6 | phthalic | .050 | 24.1 | .18 | 2.60 | 385 |
| 7 | phthalic | .065 | 31.3 | .20 | 2.64 | 498 |
| 8 | phthalic | .080 | 38.6 | .20 | 2.54 | 415 |
| 9 | 4-methyl phthalic | .0054 | 2.5 | .18 | 2.49 | 137 |
| 10 | 4-methyl phthalic | .0217 | 9.6 | .19 | 2.79 | 672 |
| 11 | 4-methyl phthalic | .054 | 24.1 | .20 | 2.71 | 642 |
| 12 | 4-methyl phthalic | .119 | 53 | .29 | 2.64 | 509 |

[a]HMPAZ = 2-(hydroxymethyl)-1(2H)-phthalazinone toning agent precursor

The data in Table VII show that the optimum concentration of phthalic acid is about 0.065 percent by weight at the given concentration of 2-(hydroxymethyl)-1(2H)-phthalazinone and the optimum concentration of 4-methylphthalic acid is about 0.0217 percent by weight at the given concentration of 2-(hydroxymethyl)-1(2H)-phthalazinone.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A heat-developable light-sensitive article having on a support at least one layer comprising
   (a) at least one light-sensitive silver halide or light-sensitive silver-halide forming component;
   (b) at least one organic silver salt;
   (c) at least one reducing agent for silver ion;
   (d) 2-(hydroxymethyl)-1(2H)-phthalazinone as a toning agent precursor, and
   (e) in a catalytically effective amount, an aromatic polycarboxylic acid or derivative thereof, an aromatic polycarboxylic anhydride or derivative thereof, or an heterocyclic polycarboxylic acid or derivative thereof as a catalyst for said toning agent precursor.

2. The article of claim 1 wherein said catalyst thereof is represented by the general formulas:

$$R(COOH)_n \text{ and } R(CH_2COOH)_n$$

wherein

R represents a member of the group selected from the group consisting of monocyclic carbocyclic aromatic radicals, polycyclic carbocyclic aromatic radicals having up to three fused rings, and monocyclic heterocyclic radicals, and n is an integer from 2 to 4, inclusive.

3. The article of claim 1 wherein said catalyst is an aromatic dicarboxylic acid or derivative thereof.

4. The article of claim 3 wherein said aromatic dicarboxylic acid or derivative thereof is phthalic acid or a derivative thereof.

5. The article of claim 3 wherein said aromatic dicarboxylic acid or derivative thereof is 2,3-naphthalenedicarboxylic acid or derivative thereof.

6. The article of claim 3 wherein said aromatic dicarboxylic acid or derivative thereof is 4-methylphthalic acid or derivative thereof.

7. The article of claim 1 wherein said catalyst is an aromatic tricarboxylic acid or derivative thereof.

8. The article of claim 1 wherein catalyst is an aromatic tetracarboxylic acid or derivative thereof.

9. The article of claim 8 wherein said aromatic tetracarboxylic acid or derivative thereof is pyromellitic acid or derivative thereof.

10. The article of claim 1 wherein said toning agent precursor is present at a concentration of from about 0.5 to about 6.0 percent by weight, based on the weight of the layer.

11. The article of claim 10 wherein said catalyst is present at a concentration of from 0.0050 to about 0.80 percent by weight, based on the weight of the layer.

12. The material of claim 1 wherein said organic silver salt is silver behenate, said reducing agent is 2,2' methylene bis(4-methyl-6-t-butyl)phenol, and said aromatic polycarboxylic acid or derivative thereof is phthalic acid.

13. A heat-developable light-sensitive article having on a support at least one layer comprising
   (a) at least one light-sensitive silver halide or light-sensitive silver-halide forming component;
   (b) at least one organic silver salt;
   (c) at least one reducing agent for silver ion;
   (d) 2-(hydroxymethyl)-1(2H)-phthalazinone as a toning agent precursor, and
   (e) in a catalytically effective amount, a 2,3-pyridinedicarboxylic acid or derivative thereof.

14. A heat-developable light-sensitive article having on a support at least one layer comprising
   (a) at least one light-sensitive silver halide or light-sensitive silver-halide forming component;
   (b) at least one organic silver salt;
   (c) at least one reducing agent for silver ion;
   (d) 2-(hydroxymethyl)-1(2H)-phthalazinone as a toning agent precursor, and
   (e) in a catalytically effective amount, a 1,3,5-benzenetricarboxylic acid or derivative thereof.

15. A heat-developable light-sensitive article having on a support at least one layer comprising
   (a) at least one light-sensitive silver halide or light-sensitive silver-halide forming component;
   (b) at least one organic silver salt;
   (c) at least one reducing agent for silver ion;
   (d) 2-(hydroxymethyl)-1(2H)-phthalazinone as a toning agent precursor, and
   (e) in a catalytically effective amount, a 1,4 5,8-naphthalenetetracarboxylic acid or derivative thereof.

* * * * *

UNITED STATES PATENT AND TRADEMARK OFFICE

CERTIFICATE OF CORRECTION

PATENT NO. : 4,510,236

DATED : April 9, 1985

INVENTOR(S) : Gustav Gutman

It is certified that error appears in the above-identified patent and that said Letters Patent is hereby corrected as shown below:

Col. 9, line 61, "1.58" should read --158--.

Col. 12, line 44, insert a comma after "4".

Signed and Sealed this

*Sixteenth* Day of *July 1985*

[SEAL]

*Attest:*

DONALD J. QUIGG

*Attesting Officer* *Acting Commissioner of Patents and Trademarks*